United States Patent [19]

Sakashita

[11] Patent Number: 5,069,106

[45] Date of Patent: Dec. 3, 1991

[54] ELECTRONIC MUSICAL INSTRUMENT WITH MUSICAL TONE PARAMETER SWITCHING FUNCTION

[75] Inventor: Shigeo Sakashita, Hamura, Japan

[73] Assignee: Casio Computer Co., Ltd., Tokyo, Japan

[21] Appl. No.: 365,090

[22] Filed: Jun. 12, 1989

[30] Foreign Application Priority Data

Jun. 17, 1988 [JP] Japan ..... 63-80182[U]

[51] Int. Cl.[5] ..... G10H 1/02

[52] U.S. Cl. ..... 84/626; 84/737

[58] Field of Search ..... 84/601, 602, 615-620, 84/622-629, 633, 653, 658, 662, 687-690, 678, 701, 723, 742, 737-740, 600

[56] References Cited

U.S. PATENT DOCUMENTS

| | | | |
|---|---|---|---|
| 2,138,500 | 11/1938 | Miessner | 84/1.01 |
| 2,301,184 | 11/1942 | Arnold | 84/1.01 |
| 2,868,876 | 1/1959 | Ticchioni | 84/1.01 |
| 3,429,976 | 2/1964 | Tomcik | 84/1.12 |
| 3,439,106 | 4/1968 | Goodale | 84/1.27 |
| 3,767,833 | 10/1973 | Noble et al. | 84/1.01 |
| 3,938,419 | 2/1976 | DeRosa | 84/1.27 |
| 4,829,869 | 5/1989 | Katada et al. | 84/622 |
| 4,875,400 | 10/1989 | Okuda et al. | 84/626 |
| 4,920,850 | 5/1990 | Matsumoto et al. | 84/626 X |

FOREIGN PATENT DOCUMENTS 1393542 5/1975 United Kingdom .

*Primary Examiner*—W. B. Perkey

*Attorney, Agent, or Firm*—Frishauf, Holtz, Goodman & Woodward

[57] ABSTRACT

An electronic musical instrument includes a musical tone generation instructor for detecting a breath operation state at a mouthpiece portion arranged on an instrument main body and instructing generation of a musical tone, a lip detection part for detecting a biting strength at said mouthpiece portion, a control information output part for outputting a plurality of parameter control information for variably controlling contents of at least one parameter of a musical tone to be generated so as to be varied in accordance with the biting strength detected by the lip detection part on the basis of instruction by the musical tone generation instructing part, a designation part for designating an arbitrary one of the plurality of parameter control information to be output from the control information output part, and a control part for, when the biting strength at the mouthpiece portion is detected by the lip detection part under a condition that the one parameter control information is designated by the designation part, outputting the one parameter control information in response to detection of the biting strength and for variably controlling a parameter of the musical tone generated by the musical tone generation instructing part in accordance with the parameter control information.

33 Claims, 9 Drawing Sheets

ELECTRONIC MUSICAL INSTRUMENT WITH MUSICAL TONE PARAMETER SWITCHING FUNCTION

BACKGROUND OF THE INVENTION

1. Field of the Invention

The present invention relates to an electronic musical instrument which is effectively applied to, for example, an electronic wind instrument, an electronic keyboard instrument, or an electronic stringed instrument and, more particularly, to a designation technique of musical tone parameters.

2. Description of the Related Art

Recently, along with rapid advance of electronics and digital techniques, electronic musical instruments utilizing these techniques have been developed. As one of these electronic musical instruments, an electronic wind instrument is known. The electronic wind instrument detects a breath or lip operation by an operator (player) as an electrical signal using a breath or lip sensor arranged at its mouthpiece portion, thus finely controlling a tone volume or pitch of an electronically generated musical tone. The electronic wind instrument can generate a musical tone matching with sensitiveness of a player.

As the electronic wind instrument described above, for example, U.S. Pat. Nos. 3,767,833; 2,301,184; 2,868,876; 3,429,976; 3,439,106; and 3,938,419 are known. Of these electronic wind instruments, those disclosed in U.S. Pat. Nos. 3,767,833 and 2,301,184 have an arrangement wherein a pitch of a musical tone generated in response to a breath operation at a mouthpiece portion can be finely changed or modified, by changing a biting strength of the mouthpiece portion.

However, in the above conventional electronic wind instruments, although a pitch of a musical tone to be generated can be variably controlled by changing the biting strength of the mouthpiece portion, the biting strength and the pitch of a musical tone to be controlled merely have a given relationship. For this reason, when the biting strength and the pitch of a musical tone have a proportional relationship, if the biting strength is gradually increased, the pitch of a musical tone is also gradually increased. On the other hand, when the biting strength and the pitch of a musical tone have an inverse proportional relationship, if the biting strength is gradually increased, the pitch of a musical tone is gradually decreased. Thus, it is impossible to switch the relationship between the biting strength and the pitch of a musical tone during a breath performance. More specifically, if a proportional relationship between the biting strength and the pitch of a musical tone in a first half portion of a music is preset, it is impossible to set an inverse proportional relationship between the biting strength and the pitch in a second half portion of the music. Further, upon switching of the relationship, a tone color cannot be switched at the same time. For this reason, a performance with abundant expressions cannot be attained.

SUMMARY OF THE INVENTION

The present invention has been made in consideration of the above problems.

It is accordingly an object of the present invention to provide an electronic musical instrument which can quickly and easily select a control information outputting means which outputs a plurality of pieces of parameter control information for variably controlling musical tone parameters in accordance with a performance input state by a player.

It is another object of the present invention to provide an electronic musical instrument which can select an arbitrary one of a large number of control information outputting means by a very small number of selection means without using a large number of selection means.

It is still another object of the present invention to provide an electronic musical instrument which can designate a parameter (for example, a tone color) of a musical tone to be generated simultaneously when the arbitrary one of the control information outputting means is selected.

According to the present invention, there is provided an electronic musical instrument comprising musical tone generation instructing means for detecting a breath operation state at a mouthpiece portion arranged on an instrument main body and instructing generation of a musical tone, lip detection means for detecting a biting strength at said mouthpiece portion, control information output means for outputting a plurality of parameter control information for variably controlling a content of at least one parameter of a musical tone to be generated so as to be varied in accordance with the biting strength detected by said lip detection means on the basis of instruction by said musical tone generation instructing means, designation means for designating an arbitrary one of the plurality of parameter control information to be output from said control information output means, and control means for, when the biting strength at said mouthpiece portion is detected by said lip detection means under a condition that the one parameter control information is designated by said designation means, outputting the one parameter control information in response to detection of the biting strength and for variably controlling a parameter of a musical tone generated by said musical tone generation instructing means in accordance with the parameter control information.

Note that the term "breath operation state" is an operation state obtained by blowing a breath into a mouthpiece portion.

According to another aspect of the present invention, there is provided an electronic musical instrument comprising musical tone generation instructing means for detecting a breath operation state at a mouthpiece portion arranged on an instrument main body and instructing generation of a musical tone, control information output means for outputting a plurality of parameter control information for variably controlling a content of at least one parameter of a musical tone to be generated so as to be varied in accordance with the breath operation state detected by said musical tone generation instructing means on the basis of instruction by said musical tone generation instructing means, designation means for designating an arbitrary one of the plurality of parameter control information to be output from said control information output means, and control means for, when the breath operation state is detected by said musical tone generation instructing means under a condition that the one parameter control information is designated by said designation means, outputting the one parameter control information in response to detection of the breath operation state and for variably controlling a parameter of a musical tone generated by said musical tone generation instructing means in accordance with the parameter control information.

According to still another aspect of the present invention, there is provided an electronic musical instrument comprising detection means for detecting a performance input state by a player, registration means for registering, as a plurality of sets of registration data, a plurality of pairs of parameter control information for variably controlling a content of at least one parameter of a musical tone to be generated in accordance with the performance input state detected by said detection means, and parameter designation information for designating at least one parameter of a musical tone to be generated, designation means for designating an arbitrary one of the plurality of sets of registration data registered in said registration means, and control means for, when the performance input state by the player is detected by said detection means under a condition that the set of registration data is designated by said designation means, variably controlling a musical tone which has a specific parameter designated by the parameter designation information in the set of the registration data in accordance with the parameter control information in the set of registration data in response to detection of the performance input state.

An arrangement of an electronic wind instrument according to the present invention w 11 be described below.

A mouthpiece portion, for example, is formed at the upper end of a tubular barrel, and a sensor means for detecting at least one of breath and lip operations at the mouthpiece portion as a sense signal is arranged, for example, in the mouthpiece portion.

A conversion table storage means for storing conversion tables, corresponding to a plurality of characteristics, for outputting first musical tone control information for controlling at least one of a pitch, tone volume, and tone quality of a musical tone in correspondence with the sense signal is arranged in the tubular barrel.

A registration data setting means for setting registration data as a pair of selection information of, for example, a table number of the conversion tables and at least one second musical tone control information is arranged on the tubular barrel.

A registration data storage means for storing a plurality of sets of registration data, being set by the above setting means, is arranged, for example, in the tubular barrel.

Furthermore, a registration data designation means for designating an arbitrary one of the registration data stored in the registration data storage means is arranged, for example, on the tubular barrel.

In addition, a musical tone control means for outputting the first musical tone control information corresponding to the sense signal from the sensor means, on the basis of the conversion table in the conversion table storage means selected by the selection information (table number or the like) in the registration data designated by the designation means, and for outputting the second musical tone information in the designated registration data is arranged, for example, in the tubular barrel.

A musical tone generating means for generating a musical tone, controlled by the output first musical tone control information and by the output second musical tone control information, is arranged, for example, in the tubular barrel.

In the above arrangement, a player operates the registration data setting means in advance to designate a plurality of sets of registration data necessary for a performance. These registration data are stored in the registration data storage means. The registration data being set in this case is formed of selection information, such as a table number or the like, for selecting a desired one of the plurality of conversion tables stored in the conversion table storage means, and second musical tone control information, such as tone color designation information or the like.

Thereafter, the player performs a breath or lip operation at the mouthpiece portion to initiate his or her performance, and continues the performance while designating pitches of musical tones using a pitch designation means. During progress of the performance, the player sequentially operates the registration data designation means to designate desired registration data to the registration data storage means.

The musical tone control means accesses the corresponding conversion table in the conversion table storage means on the basis of the selection data (table number) in the designated registration data. A lip sense signal output from the sensor means in response to, for example, a lip operation at the mouthpiece portion is used to refer the conversion table. Thus, the conversion table outputs, for example, the first musical tone control information for pitch control to the musical tone generating means. At the same time, the musical tone control means outputs, for example, the second musical tone control information for tone color designation in the designated registration data to the musical tone generating means.

With the above operation, a parameter such as a pitch of a musical tone can be controlled in correspondence with a lip operation in accordance with a control characteristic of the conversion table selected by the designated registration data. For this reason, if designation of the registration data is sequentially changed during a performance, the parameter of a musical tone corresponding to the lip operation can be sequentially changed. At the same time, a parameter, such as a tone color or the like, can be switched. Therefore, a plurality of pieces of musical tone control information can be instantaneously changed by a one-touch operation.

In general, only several sets of registration data are required for a performance of one music piece. Therefore, as the registration data designation means, a very small number of special-purpose switches for selecting pre-registered registration data need only be arranged, thus simplifying an operation.

When only selection information (table number) necessary for a performance is registered in registration data, the number of switches for selecting the conversion tables can be decreased, and many conversion tables can be stored in the conversion table storage means.

DETAILED DESCRIPTION OF THE PREFERRED EMBODIMENTS

An embodiment of the present invention will now be described in detail.

Construction

Figure 1:
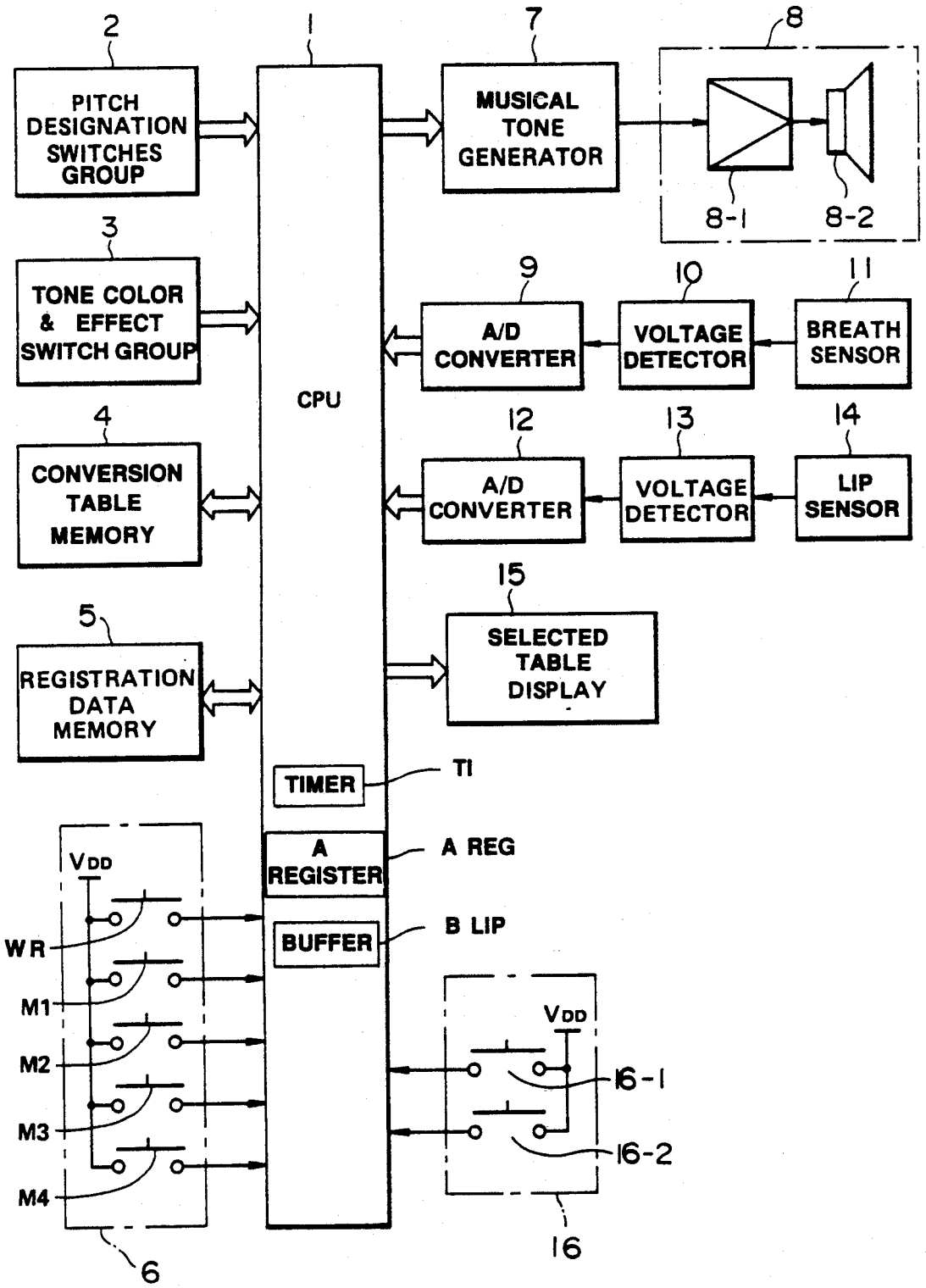
FIG. 1 is a block diagram of the overall circuit according to an embodiment of the present invention.

FIG. 1 is a block diagram of an embodiment of the present invention.

Pitch (scale) information designated by pitch designation switch group 2 is input to CPU (central processing unit) 1.

Tone color & effect switch group 3 includes switches for switching musical tone colors, effects, and the like generated by musical tone generator 7 on the basis of a pitch designated by pitch designation switch group 2. Switching information of a tone color or effect designated by switch group 3 is input to CPU 1.

Conversion table memory 4 stores six kinds of conversion tables (to be described later) each for converting lip sense data (to be described later) input from CPU 1 into pitch conversion data (to be described later) and outputting the conversion data to CPU 1.

Registration data memory 5 is connected to CPU 1. Memory 5 stores four sets of registration data each consisting of a conversion table number and tone color information or other effect information.

Conversion table selection switch group 16 is connected to CPU 1. Switch group 16 changes a conversion table number stored in registration data memory 5. Up switch 16-1 is used to increment a conversion table number, and down switch 16-2 is used to decrement the table number. Switches 16-1 and 16-2 are applied with drive power supply $V_{DD}$.

Registration data selection switch group 6 is connected to CPU 1. When one of selection switches M1 to M4 is operated, a corresponding one of the four sets of registration data stored in registration data memory 5 is selected. When one of switches M1 to M4 and selection switch WR are operated at the same time, the selected registration data to be set next is written in memory 5. Switches M1 to M4 and WR are applied with drive power supply $V_{DD}$.

Selected table display 15 is connected to CPU 1, and displays a conversion table number in the presently selected registration data.

Breath sensor 11 senses a strength or amount of breath blown into a mouthpiece portion (FIG. 2B) by an operator (or player), and a voltage according to the sensed strength or amount is detected by voltage detector 10. The detected voltage is converted into digital data by A/D converter 9. The digital data is input to CPU 1.

Lip sensor 14 senses a biting strength by lips of an operator at mouthpiece portion 18, and a voltage representing the biting strength is detected by voltage detector 13. The detected voltage is converted to 8-bit digital data by A/D converter 12. The digital data is input to CPU 1.

Musical tone generator 7 is connected to CPU 1, and generates a musical tone on the basis of control information from CPU 1. The musical tone generated by generator 7 is input to musical tone output unit 8.

Musical tone output unit 8 comprises amplifier 8-1 and loudspeaker 8-2, and produces a musical tone as a sound.

Figure 2A:
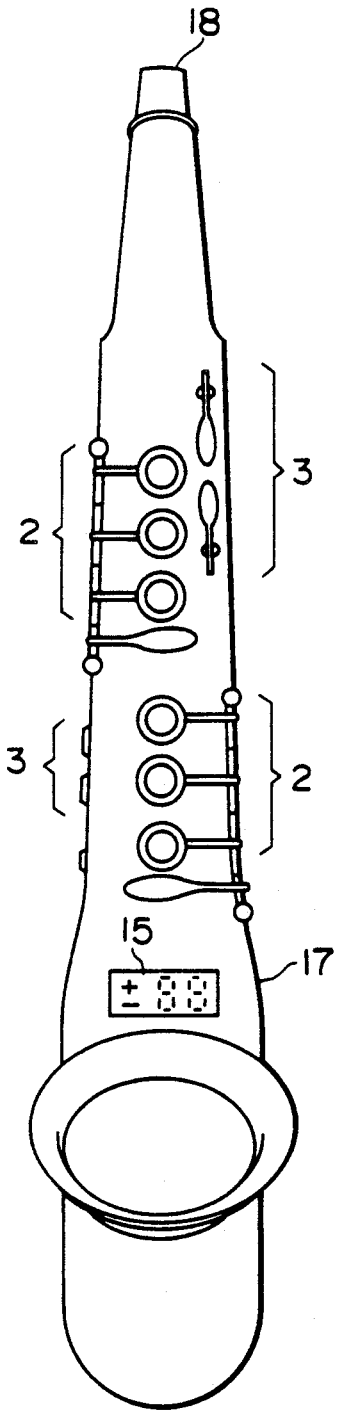
FIGS. 2A and 2B are respectively a front view and a right side view of an electronic wind instrument according to the present invention.
Figure 2B:
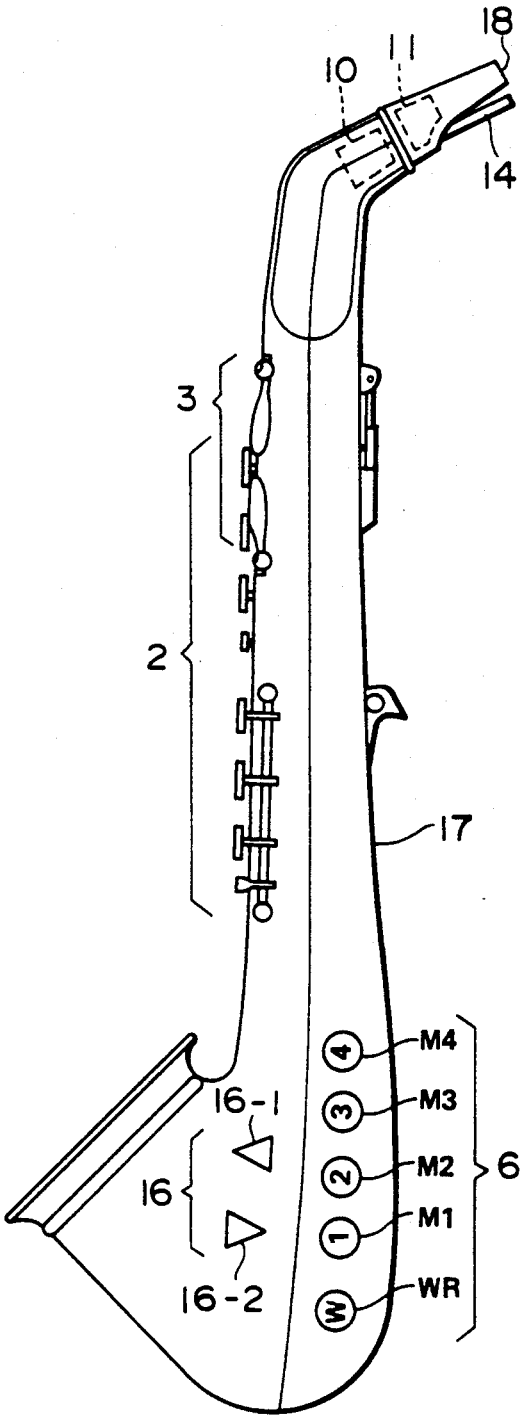

FIGS. 2A and 2B show an outer appearance of an electronic wind instrument realized by the embodiment shown in FIG. 1.

As shown in FIGS. 2A and 2B, this embodiment has a shape of a wind instrument having tubular barrel 17 as a main body. Pitch designation switch group 2, tone color & effect switch group 3, registration data selection switch group 6 containing selection switches M1 to M4 and WR, and conversion table selection switch group 16 containing up and down switches 16-1 and 16-2 described in FIG. 1 are arranged at positions on tubular barrel 17 where a player can easily touch them. Selected table display 15 is arranged at a position on tubular barrel 17 where it is easy to see.

Breath sensor 11 and its voltage detector 10, and lip sensor 14 and its voltage detector 13 shown in FIG. 1 are arranged in mouthpiece portion 18 formed on an upper portion of tubular barrel 17 shown in FIGS. 2A and 2B.

Summary of Operation

The operation of the embodiment with the arrangement shown in FIGS. 1 to 2B will be described below. A description will be made with reference to FIGS. 1 to 2B unless otherwise specified.

The general operation of the embodiment of the present invention will be described below.

A player blows a breath into mouthpiece portion 18 while designating pitches by operating pitch designation switch group 2 with his or her fingers, thus initiating a performance. In this case, CPU 1 monitors the operation content of pitch designation switch group 2 at predetermined time intervals using a given program (not shown). When CPU 1 detects that the designation content is changed, it outputs changed pitch information to musical tone generator 7. Musical tone generator 7 thus sets a pitch (scale) of a musical tone to be generated so as to generate a musical tone having the designated pitch.

A strength of a breath blown from mouthpiece portion 18 is detected as breath data by breath sensor 11. When the breath data exceeds a given value, i.e., when the player blows a breath exceeding a given strength, CPU 1 outputs key-ON information to musical tone generator 7 in response to the breath data. Musical tone generator 7 starts generation of a musical tone at a pitch designated by the pitch designation operation. Contrary to this, when the player stops blowing a breath into mouthpiece portion 18 and breath data becomes smaller than the given value, CPU 1 outputs key-OFF information to musical tone generator 7 in response to the breath data. Thus, musical tone generator 7 stops generation of the musical tone.

In the above operation, the breath data is input to CPU 1. The breath data is converted to tone volume conversion data by a specific means (not shown). The tone volume conversion data is input to musical tone generator 7 through CPU 1. As a result, a tone volume of a musical tone to be generated is controlled in accordance with the strength of a breath blown by the player.

A biting strength by lips at mouthpiece portion 18 is detected as lip data by lip sensor 14. The lip data is input to CPU 1. Thereafter, the lip data is converted to pitch conversion data corresponding to the value of the lip data by a conversion table in conversion table memory 4. The pitch conversion data is input to musical tone generator 7 through CPU 1. As a result, a pitch of a musical tone to be generated is controlled in accordance with a biting strength by lips of the player.

Conversion table memory 4 stores six kinds of conversion tables having different conversion characteristics, as shown in FIGS. 4A to 4F. The player can prestore conversion table numbers of four arbitrary conversion tables of the six kinds of conversion tables in registration data memory 5 as registration data before a performance. Since the content of each registration data is displayed on selected table display 15, the player operates one of selection switches M1 to M4 of registration data selection switch group 6 while observing the display content. In this manner, one of the four arbitrary kinds of conversion tables stored in conversion table memory 4 can be selected by the conversion table number in the arbitrarily selected one of the four registration data during a performance. Thus, a pitch control characteristic of a musical tone with respect to the lip operation can be changed in real time.

Registration data memory 5 can store four kinds of registration data as combinations of the conversion table numbers and tone color information or other effect information. When an arbitrary one of the conversion tables is selected by selection switches M1 to M4 of registration data selection switch group 6, a tone color, effect, or the like of a musical tone generated by musical tone generator 7 can be simultaneously selected by a one-touch operation.

The conversion table number can be registered in registration data memory 5 by conversion table selection switch group 16. Similarly, tone color or effect information can be registered by tone color & effect switch group 3.

Processing associated with the lip operation will be described below.

Format of Registration Data Memory

Figure 3:
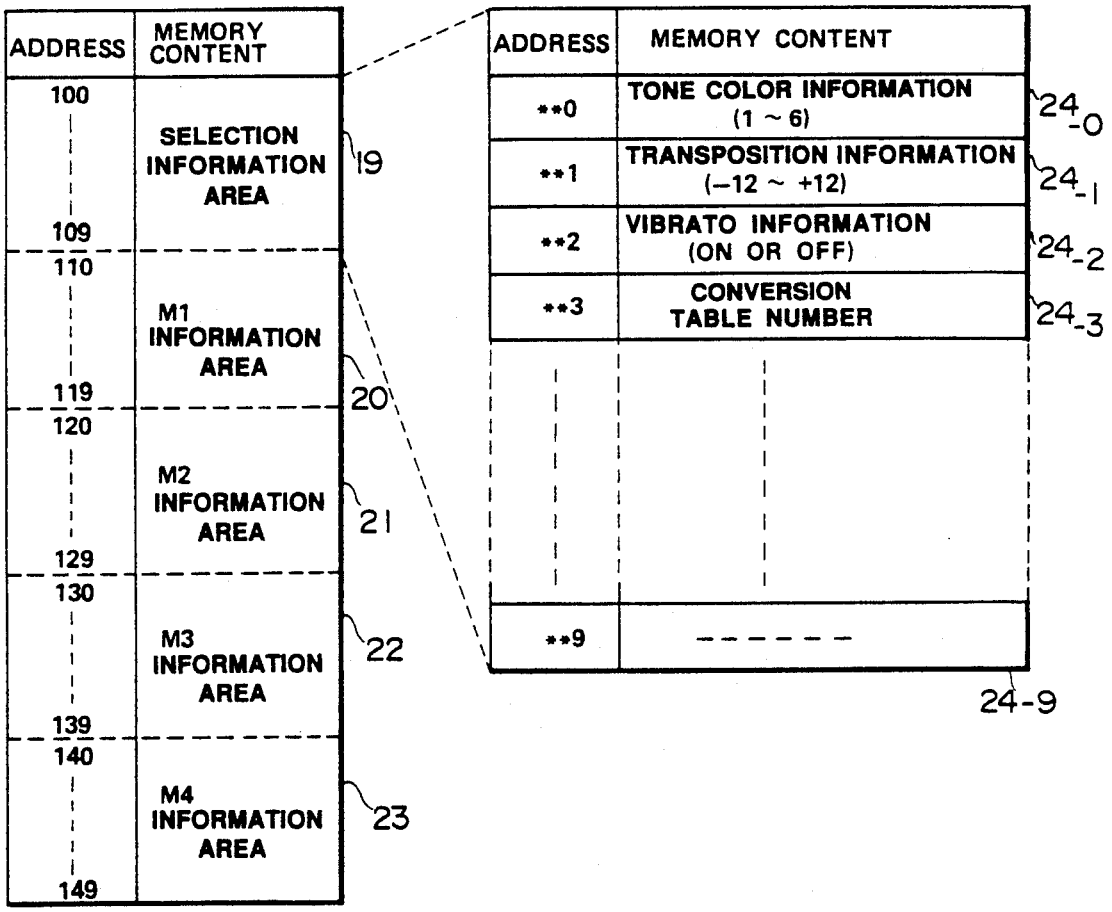
FIG. 3 shows a format of a registration data memory.

FIG. 3 shows a format of registration data memory 5 shown in FIG. 1.

M1 to M4 information areas 20 to 23 respectively allocated at addresses 110 to 119, 120 to 129, 130 to 139, and 140 to 149 are those for storing four kinds of registration data.

An arbitrary one of the four kinds of registration data stored in M1 to M4 information areas 20 to 23 is selected in real time by registration data selection switch group 6 and is copied on selection information area 19 allocated at addresses 100 to 109. A musical tone from musical tone generator 7 is controlled on the basis of the registration data copied on selection information area 19.

Contents at addresses 100 to 109 can be arbitrarily changed, as will be described later. The content of selection information area 19 can be arbitrarily copied and registered in one of M1 to M4 information areas 20 to 23 by depressing one of selection switches M1 to M4 while depressing selection switch WR, as will be described later.

Each of selection information area 19 and M1 to M4 information areas 20 to 23 are formed of ten registration data 24-0 to 24-9, as shown in FIG. 3. In addresses **0 to **9, "******" represents an arbitrary value (or optional value) selected from 10, 11, 12, 13, and 14.

Tone color information 24-0 indicates a kind of tone color of a musical tone generated by musical tone generator 7. Six kinds of tone colors can be designated by values "1" to "6".

Transposition information 24-1 is used for transposing a musical tone. Information 24-1 is incremented or decremented by "1" to transpose a musical tone by a half tone with reference to "0" as "C major", and can be designated between −12 to +12.

Vibrato information 24-2 indicates ON/OFF information, i.e., whether or not musical tone generator 7 gives a vibrato effect to a musical tone.

Conversion table number 24-3 is information indicating a kind of conversion table in conversion table memory 4. Six kinds of conversion tables can be designated by values "1" to "6"

In addition to the above information, other registration data can be stored. However, a description thereof will be omitted herein.

Format of Conversion Table Memory

FIGS. 4A to 4F respectively show conversion characteristics of the six kinds of conversion tables stored in conversion table memory 4 shown in FIG. 1.

An input to each conversion table is 8-bit lip data which can take a value ranging between 0 to 255 and is input from A/D converter 12 shown in FIG. 1 through CPU 1, and its value changes in accordance with a biting strength by lips. An output from each conversion table is pitch conversion data which can take a positive/negative value in units of cents.

Figure 4A:
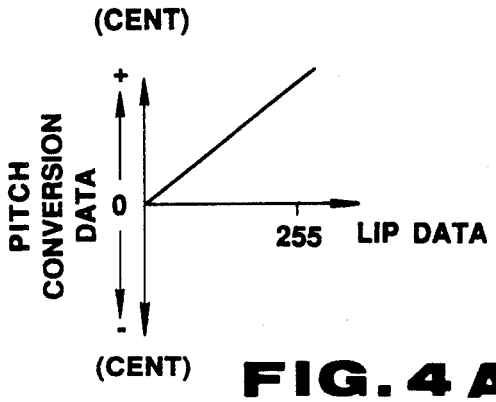
FIGS. 4A to 4F are graphs showing various characteristics of conversion tables.

FIG. 4A shows a conversion characteristic in which a pitch is linearly increased in proportion to a biting strength by lips, and has a bend-up effect.

Figure 4B:
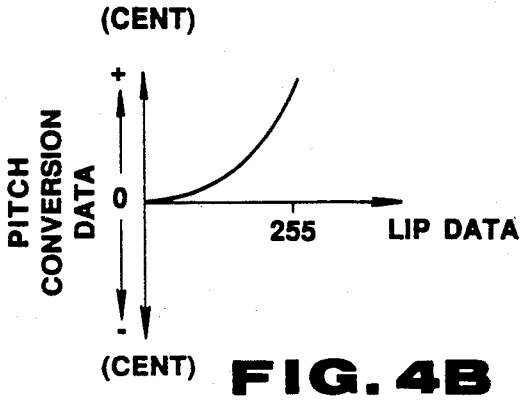

FIG. 4B shows a characteristic in which a change width of an increase in pitch is increased as a biting strength is increased, and similarly has the bend-up effect.

Figure 4C:
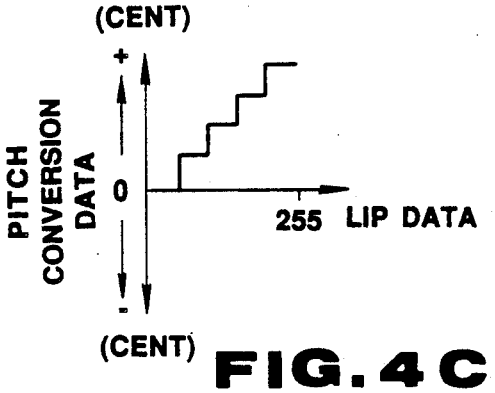

FIG. 4C shows a characteristic in which a pitch changes stepwise in accordance with the biting strength, and has an arpeggio effect.

Figure 4D:
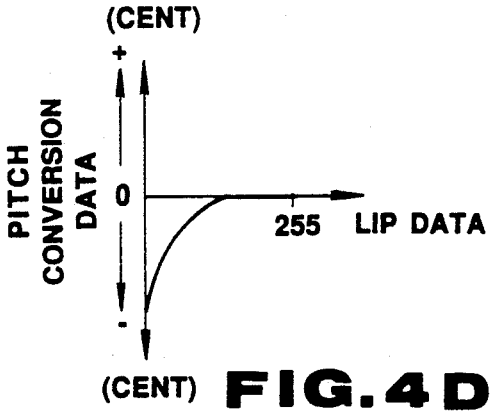

FIG. 4D shows a characteristic in which when a biting strength is 0, a pitch is set to be smaller than a regular pitch and when it exceeds a given value, the regular pitch is obtained, and has a bend-down effect. In this case, the player normally plays the instrument while biting the mouthpiece portion, and weakens a biting strength to obtain the effect.

Figure 4E:
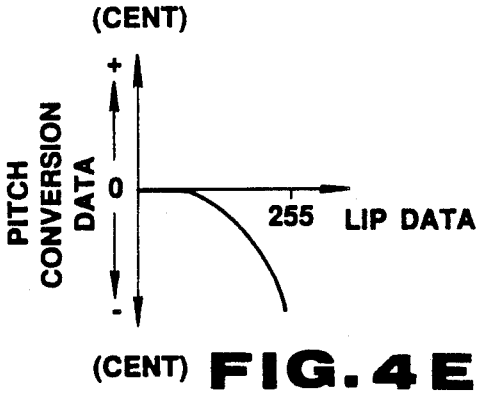

FIG. 4E shows a characteristic in which a pitch is decreased as a biting strength is increased, and also has the bend-down effect. In this case, the player normally plays the instrument without biting the mouthpiece portion, and strongly bites the mouthpiece portion to obtain the effect.

Figure 4F:
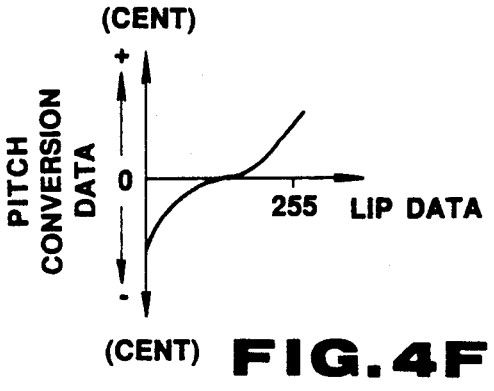

FIG. 4F shows a characteristic in which a performance is made at a regular pitch at a middle biting strength, and a pitch is increased as a biting strength exceeds the middle strength and is decreased as the biting strength is decreased to be weaker than the middle strength.

Operation of Lip Data Processing

A detailed operation when CPU 1 outputs pitch conversion data corresponding to lip data to musical tone generator 7 using registration data memory 5 and conversion table memory 4 to perform pitch control of a musical tone will be described below with reference to the flow chart shown in FIG. 5.

Figure 5:
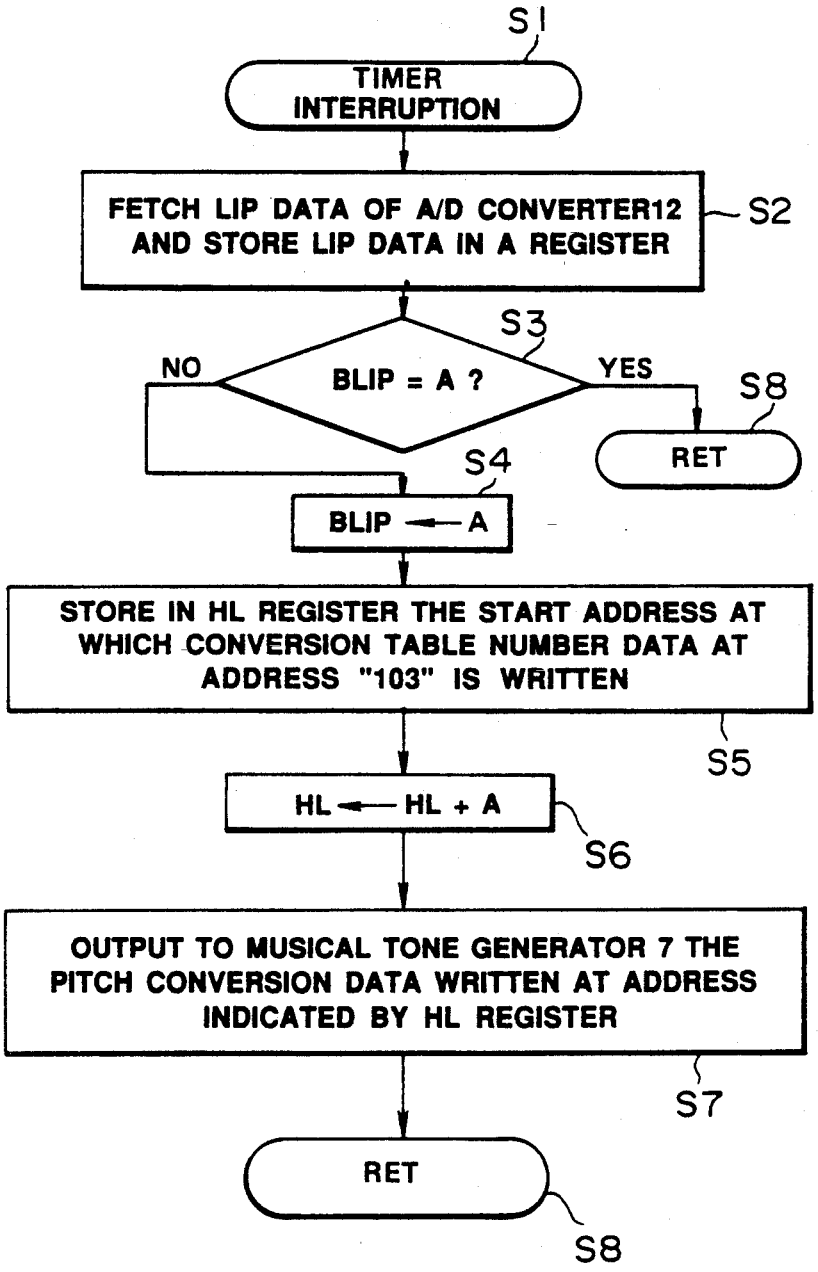
FIG. 5 is an operation flow chart of lip data processing.

CPU 1 executes a program according to the flow chart shown in FIG. 5 upon interruption from timer TI incorporated in CPU 1 so as to perform the conversion processing at predetermined time intervals.

If timer interruption occurs (S1 in FIG. 5), lip data from A/D converter 12 is stored in A register AREG in CPU 1 (S2).

CPU 1 includes buffer BLIP which holds the content (lip data 10) of A register AREG in immediately preceding processing. It is checked if the content of buffer BLIP is equal to the content of A register AREG (S3).

If the contents are equal to each other, it is determined that the value of the lip data is the same as that in the immediately preceding processing. In this case, the control returns to an original state without performing any processing (S3→S8). Thus, musical tone generator 7 continuously generates a musical tone having an identical pitch.

In contrast to this, if it is determined in step S3 that the content of buffer BLIP is not equal to that of A register AREG, the content of buffer BLIP is updated with the content of A register AREG for the next processing (S3→S4).

Based on a conversion table number (FIG. 3) stored at address "103" in registration data memory 5, CPU 1 calculates a start address of a conversion table corresponding to the number on conversion table memory 4, and sets the calculated address in an HL register (2 bytes) (S5).

Assume that conversion table memory 4 stores pitch conversion data (not shown) corresponding to values of "0" to "255" of lip data from the predetermined six start addresses (separated from each other by at least 256 addresses) to addresses each obtained by adding a maximum of 255 to the corresponding start address. The above pitch conversion data serve as six kinds of conversion tables respectively having the characteristics of FIGS. 4A–4F. Therefore, the content at an address obtained by adding the value of lip data to the start address of the conversion table set in the HL register is read out, thus obtaining corresponding pitch conversion data.

That is, the value of the HL register is added to the value of the A register, and the sum is set in the HL register (S6).

Thereafter, CPU 1 outputs pitch conversion data written at an address on conversion table memory 4 indicated by the HL register to musical tone generator 7, and the control returns to an original state.

Thus, the conversion table corresponding to the conversion table number stored at address "103" on registration data memory 5 is accessed on conversion table memory 4, and pitch conversion data corresponding to the lip data is output to musical tone generator 7.

In the above operation, as will be described later, the player turns on an arbitrary one of selection switches M1 to M4 of registration selection switch group 6 during a performance to update the content of conversion table number 24-3 at address "103" in registration data memory 5 with one of the contents stored in M1 to M4 information areas 20 to 23 (FIG. 3) at addresses "114", "124", "134", and "144". Thus, a pitch control characteristic of a musical tone can be changed in real time.

When musical tone generator 7 receives pitch conversion data in units of cents from CPU 1 in the above operation, it changes a pitch of a musical tone which is being produced.

Changing/Setting Operation of Conversion Table

An operation when the player arbitrarily changes and sets the conversion table (FIGS. 4A to 4F) for converting lip data into pitch conversion data will be described below.

The conversion tables can be changed by operating up or down switch 16-1 or 16-2 of conversion table selection switch group 16. Thus, conversion table number 24-3 at address "103" in selection information area 19 in FIG. 3 is updated by ±1.

CPU 1 performs the above operation in accordance with a predetermined changing/setting program by scanning setting states of up and down switches 16-1 and 16-2 at predetermined time intervals.

Figure 6:
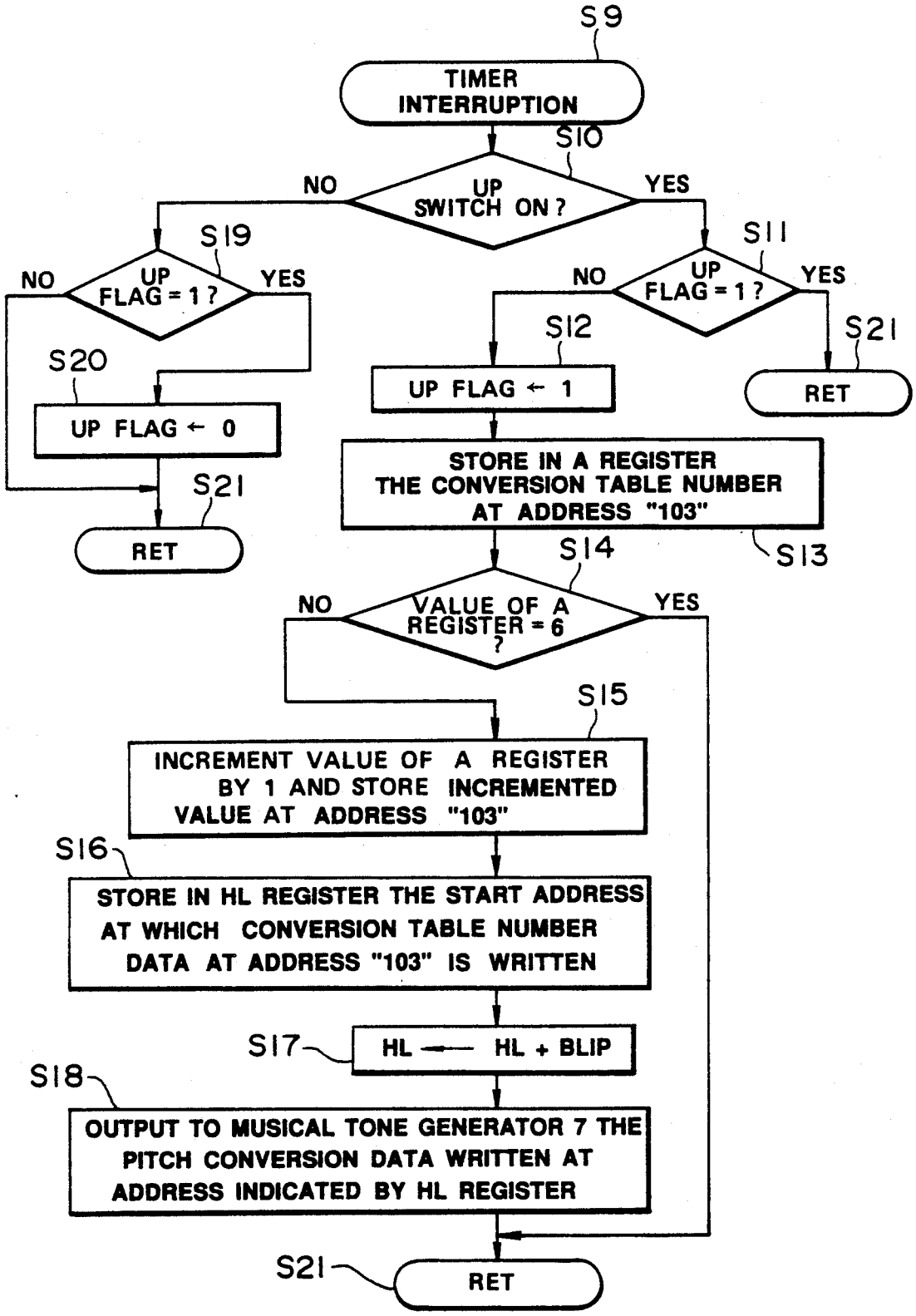
FIG. 6 is a flow chart of a scan operation of an up switch in a conversion table selection switch group.

FIG. 6 is a flow chart when CPU 1 scans up switch 16-1. If timer interruption occurs as in FIG. 5 (S9 in FIG. 6), CPU 1 checks if up switch 16-1 is ON (S10).

If the up switch is OFF (S10→S19), it is checked if an UP flag (not shown) in CPU 1 is "1" (or "0"). If the UP flag is "0", the control returns to an original state (standby state) (S19→S21). If the UP flag is "1", the UP flag is set to be "0", and control returns to an original state (S19→S20→S21). The function of the UP flag will be described later.

If up switch 16-1 is turned on (S10→S11), since the UP flag is "0", the flag is set to be "1" (S11→S12). Thereafter, conversion table number 24-3 (FIG. 3) at address "103" in registration data memory 5 is stored in A register AREG in CPU 1 (S13).

It is then checked if the value of A register AREG is "6" (or smaller than "6"). If the value of the A register is "6", the control returns to an original state without performing any processing (S14→S21).

If the value of the A register is smaller than "6", it is incremented by 1, and the incremented value is stored at address "103" in registration data memory 5 (S14→S15). With this operation, every time the player turns on up switch 16-1, conversion table number 24-3 (FIG. 3) at address "103" in registration data memory 5 is incremented by 1 within a range of 6 or less.

Based on the conversion table number stored at address "103", CPU 1 calculates a start address of the conversion table corresponding to the number on conversion table memory 4, and sets the calculated address in the HL register (2 bytes) (S16). Subsequently, the value of the HL register is added to the value of buffer BLIP, and the sum is set in the HL register (S17). Pitch conversion data written at an address on conversion table memory 4 indicated by the HL register is output to musical tone generator 7. The control then returns to an original state (S18→S21).

Processing in steps S16 to S18 is substantially the same as that in steps S5 to S7 in FIG. 5. Therefore, when the player operates up switch 16-1 to change conversion table number 24-3 (FIG. 3) at address "103" in registration data memory 5, the conversion table corresponding to conversion table number 24-3 stored at address "103" is accessed on conversion table memory 4, and pitch conversion data corresponding to the lip data is forcibly output to musical tone generator 7. This processing corresponds to the fact that when conversion table number 24-3 is changed, pitch conversion data which is output in correspondence with the table number is changed if the lip data remains the same. When the lip data is not changed (when the player performs the lip operation with the same strength) and even if YES is obtained in step S3 in FIG. 5, this processing is executed to output new pitch conversion data.

In FIG. 6, assume that the player continuously depresses up switch 16-1, timer interruption in step S9 occurs again, and the ON state of the up switch is detected (S10→S11). In this case, since the UP flag is "1", the control returns an original state without executing any processing, thus preventing the table number from being repetitively incremented by 1 (S11→S21).

When CPU 1 scans down switch 16-2, it is operated in accordance with the same operation flow chart as that shown in FIG. 6, and a detailed description thereof will be omitted. In this case, a DOWN flag is provided in CPU 1 in place of the UP flag in FIG. 6. In step S10 in FIG. 6, whether or not down switch 16-2 is ON is checked. In step S14, whether or not the value of the A register is "1" (or larger than "1") is checked. In step S15, the value of the A register is decremented by 1, and the decremented value is stored at address "103" in registration data memory 5.

With the above operation, every time the player turns on down switch 16-2, conversion table number 24-3 (FIG. 3) at address "103" in registration data memory 5 is decremented by 1 within a range of 1 or more, and new pitch conversion data based on the updated table number is output to musical tone generator 7.

The content of conversion table number 24-3 at address "103" in registration data memory 5 after the changing operation is displayed on selected table display 15, and the player can confirm this at a glance. This processing is performed by CPU 1 in accordance with a program (not shown).

Changing/Setting Operation of Tone Color Information etc

An operation when the player arbitrarily changes and sets tone color information or the like of a musical tone will be described below.

A tone color of a musical tone can be changed by +1 between tone color numbers "1" to "6" every time a tone color switch in tone color & effect switch group 3 is turned on. Thus, tone color information 24-0 at address "100" in selection information area 19 in FIG. 3 in registration data memory 5 is changed.

CPU 1 performs the above operation in accordance with a predetermined changing/setting program by scanning a setting state of the tone color switch of tone color & effect switch group 3 at predetermined time intervals.

Figure 7:
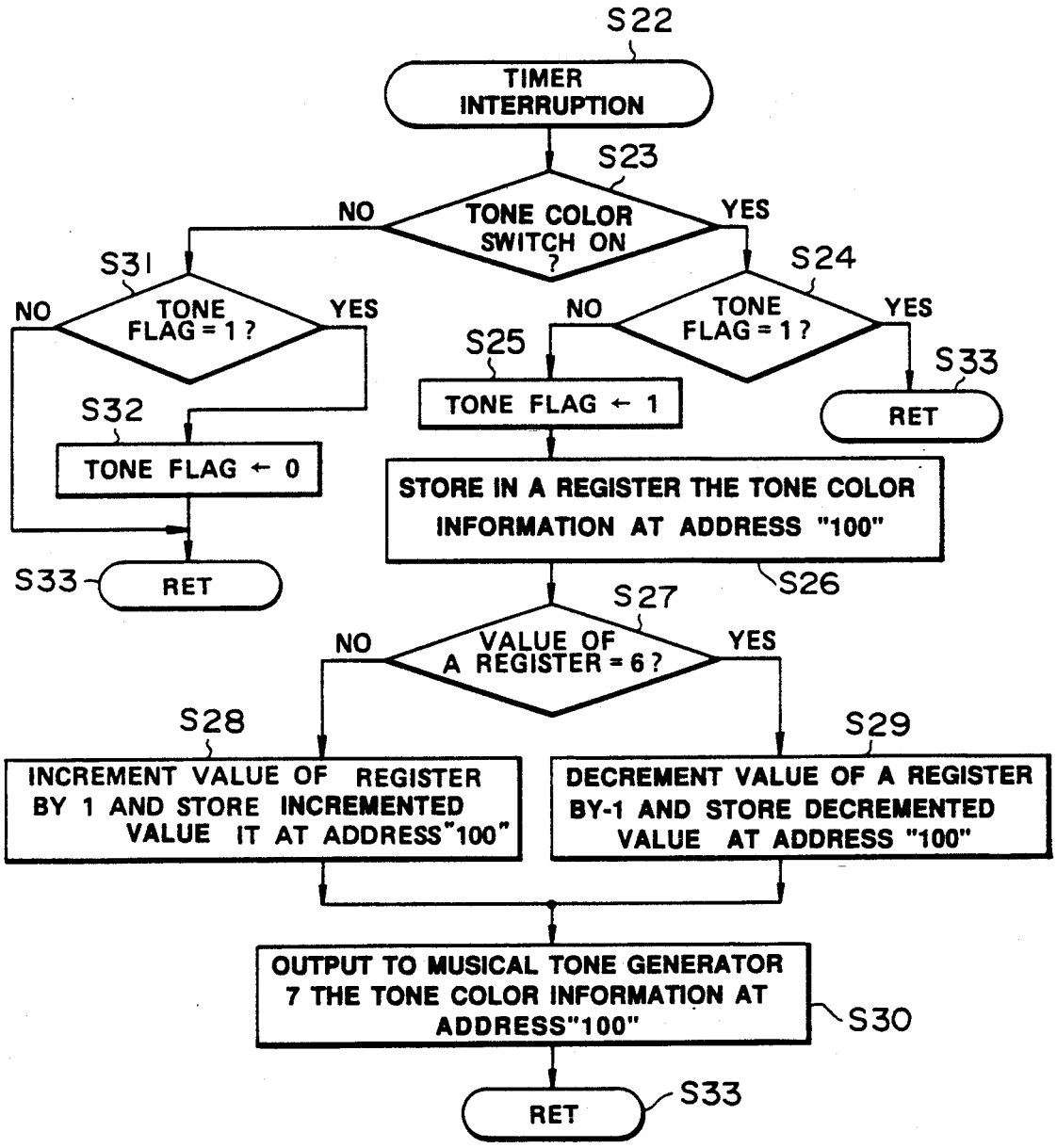
FIG. 7 is a flow chart of a scan operation of a tone color switch.

FIG. 7 shows an operation flow chart for this processing. If timer interruption occurs as in FIG. 6 (S22 in FIG. 7), CPU 1 checks if the tone color switch is ON (S23).

If the tone color switch is not ON (S23→S31), CPU 1 checks if a TONE flag (not shown; to be described later) is "1" (or "0"). If the TONE flag is "0", the control returns to an original state (S31→S33). If the TONE flag is "1", the flag is set to be "0", and the control returns to an original state (S31→S32→S33).

If the tone color switch is turned on (S23→S24), since the TONE flag is "0", the flag is set to be "1" (S24→S25). Thereafter, tone color information 24-0 (FIG. 3) at address "100" in registration data memory 5 is stored in the A register in CPU 1 (S26).

It is then checked if the value of the A register is "6" (smaller than "6"). If the value is smaller than "6", the value of the A register is incremented by 1, and the incremented value is stored at address "100" in registration data memory 5 (S27→S28).

In contrast to this, if the value of the A register is "6", the value of the A register is reset to "1", and is stored at address "100" (S27→S29).

After the above operation, tone color information 24-0 (FIG. 3) at address "100" in registration data memory 5 is output to musical tone generator 7, and the control returns to an original state (S30→S33).

With the above operation, while the player turns on the tone color switch in tone color & effect switch group 3, tone color information 24-0 (FIG. 3) at address "100" in registration data memory 5 is incremented by 1 between tone color numbers "1" to "6". At the same time, the setting content of musical tone generator 7 is instantaneously changed, and a tone color can be changed in real time.

Even if the player continuously depresses the tone color switch for a coupler tone as in FIG. 6, since the TONE flag is 1, the tone color information can be prevented from being repetitively changed (S24→S33).

An operation for changing setting contents associated with effects, e.g., transposition information 24-1, vibrato information 24-2 (FIG. 3), and the like of a musical tone is performed in the same manner as in the tone color changing operation by operating corresponding switches in tone color & effect switch group 3 by the player, and its operation flow chart can be realized by one similar to that shown in FIG. 7. Therefore, a detailed description thereof will be omitted. In either case, every time the corresponding switch is operated, information 24-1 and information 24-2 at addresses "101", "102", and the like in registration data memory 5 are changed. At the same time, the setting content of musical tone generator 7 can be instantaneously changed in the same manner as in the tone color changing operation, and an effect for a coupler tone can be changed in real time.

Registration Operation of Registration Data

An operation for copying and registering contents in selection information area 19 (FIG. 3) at addresses "100" to "109" in registration data memory 5, which are changed and set according to FIGS. 6 and 7, and the like to one of M1 to M4 information areas 20 to 23 (FIG. 3) in memory 5 will be described below.

The registration operation can be performed such that the player depresses a desired one of selection switches M1 to M4 while depressing selection switch WR of registration data selection switch group 6.

CPU 1 performs the above operation in accordance with a predetermined registration program by scanning setting states of the selection switches of registration data selection switch group 6 at predetermined time intervals.

Figure 8:
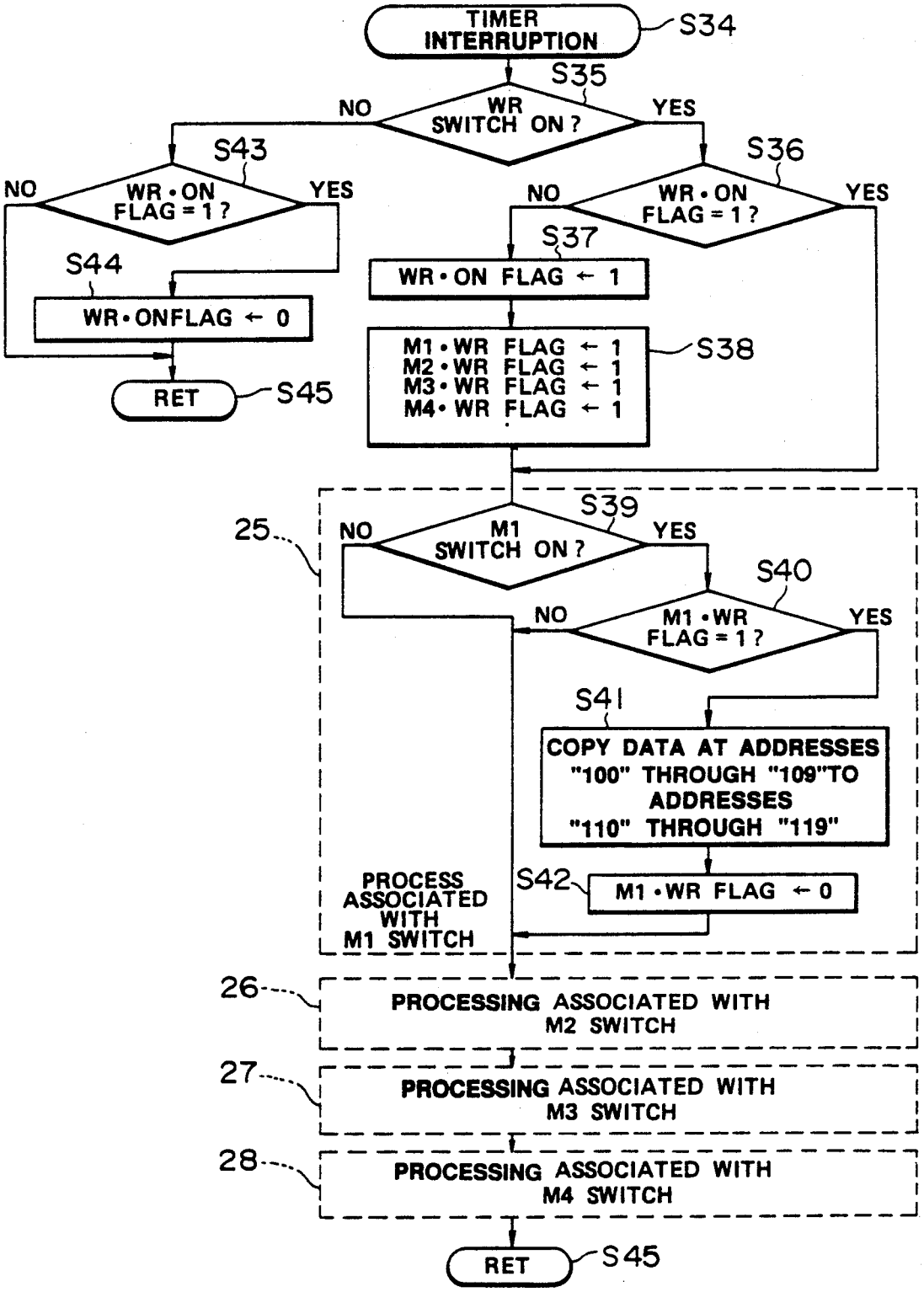
FIG. 8 is a flow chart of a registration operation of registration data.

FIG. 8 shows an operation flow chart for this processing. If timer interruption occurs as in FIG. 6 (S34 in FIG. 8), CPU 1 checks if selection switch WR is ON (S35).

If selection switch WR is not ON (S35→S43), it is checked if a WR·ON flag (not shown; to be described later) in CPU 1 is "1" (or "0"). If the WR·ON flag is "0", the control returns to an original state (S43→S45). If the WR·ON flag is "1", the flag is reset to "0", and the control returns to an original state (S43→S44→S45).

If selection switch WR is turned on (S35→S36), since the WR·ON flag is "0", the flag is set to be "1" (S36→S37). Thereafter, all the four flags, i.e., M1·WR flag to M4·WR flag (to be described later) are set to be "1" (S38).

Subsequently, processing operations associated with selection switches M1 to M4 are sequentially performed as indicated by dotted blocks 25 to 28 in FIG. 8, and the control then returns to an original state (dotted block 25→dotted block 26→dotted block 27→dotted block 28→S45). Since the processing operations in dotted blocks 25 to 28 are the same, only the processing associated with selection switch M1 in dotted block 25 will be described in detail below.

It is checked if selection switch M1 is ON (S39). If selection switch M1 is OFF, the control advances to the processing associated with selection switch M2 in dotted block 26.

If the player depresses selection switch M1 while depressing selection switch WR to turn on switch M1 (S39→S40), since the M1·WR flag is 1 (S38), data in selection information area 19 at addresses "100" to "109" in registration data memory 5 are copied to M1 information area 20 at addresses "110" to "119" (S40→S41).

The M1·WR flag is reset to "0" (S42), and the control advances to the processing associated with selection switch M2 in dotted block 26.

With the above operation, when the player turns on selection switch M1 while depressing selection switch WR of registration data selection switch group 6, the content in selection information area 19 at addresses "100" to "109" in registration data memory 5 is registered in M1 information area 20 (FIG. 3) at addresses "110" to "119".

Assume that the player continuously depresses selection switch M1 while depressing selection switch WR, timer interruption in step S34 in FIG. 8 occurs again, and it is detected that selection switch M1 is ON. In this case, since the WR·ON flag is already "1" and the M1·WR flag is reset to "0", no processing associated with selection switch M1 is performed, and control advances to processing operations 26 to 28 for remaining selection switches M2 to M4. Thus, the same data associated with switch M1 is prevented from being copied (S36→S39→S40→dotted block 26).

The same registration operation as described above to M2 to M4 information areas 21 to 23 is performed when selection switches M2 to M4 are operated.

Selection Operation of Registration Data

Contrary to the registration operation, an operation for selecting one of four sets of registration data registered in M1 to M4 information areas 20 to 23 (FIG. 3) in registration data memory 5 before a performance by the player will be described below.

The selection operation can be performed such that the player depresses a desired one of selection switches M1 to M4 without depressing selection switch WR.

CPU 1 performs this operation in accordance with a predetermined selection program by scanning setting states of registration data selection switch group 6.

Figure 9:
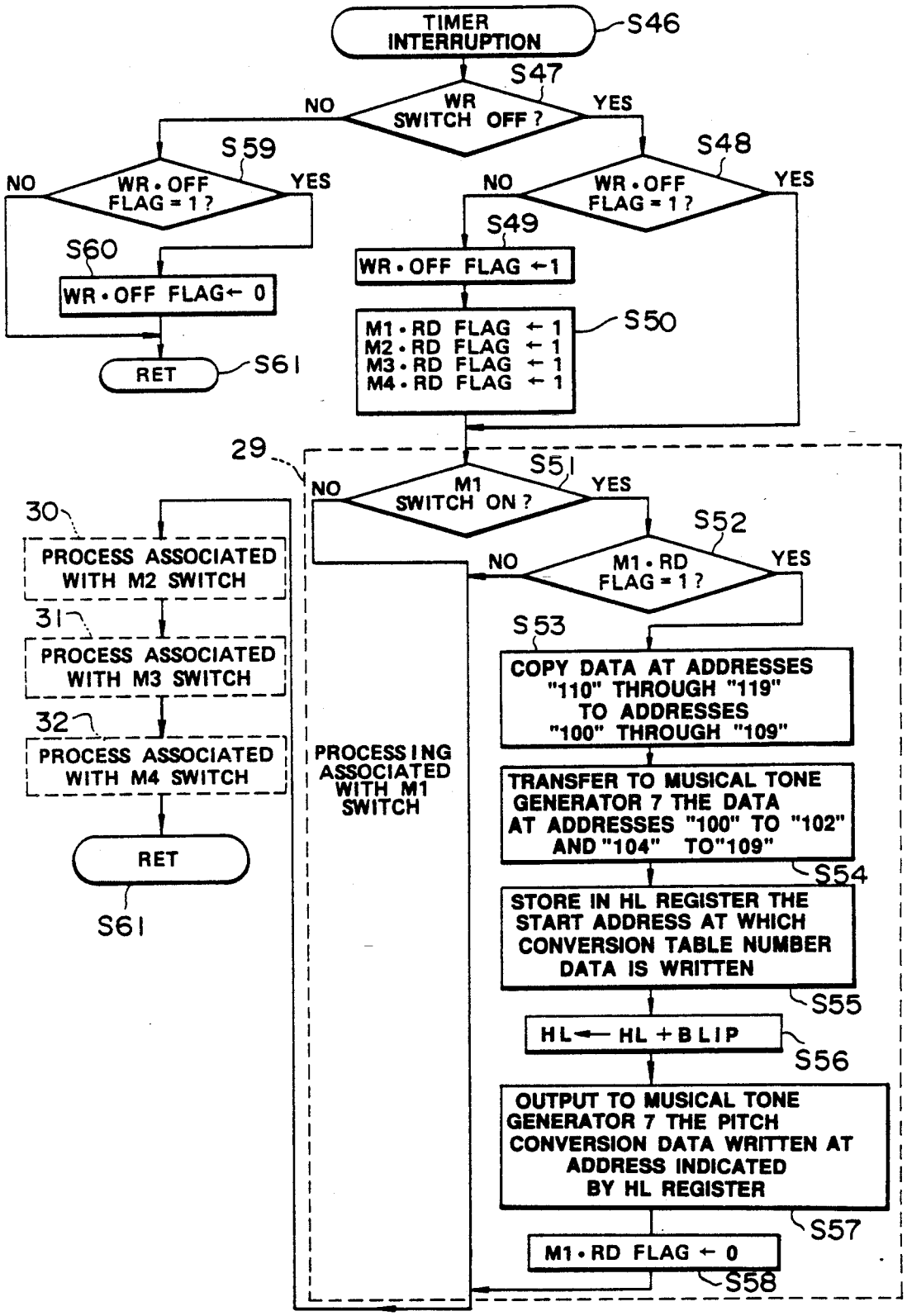
FIG. 9 is a flow chart of a selection operation of registration data.

FIG. 9 shows an operation flow chart for this processing. When timer interruption occurs as in FIG. 6 (S46 in FIG. 9), CPU 1 checks if selection switch WR is OFF (S47).

If selection switch WR is not OFF (S47→S59), it is checked if a WR·OFF flag (not shown; to be described later) is "1" (or "0") in CPU 1. If the flag is "0", the control returns to an original state (S59→S61). However, if the flag is "1", it is reset to "0", and the control returns to an original state (S59→S60→S61).

If selection switch WR is turned off (S47→S48), since the WR·OFF flag is "0", the flag is set to be "1" (S48→S49). Thereafter, all the four flags, i.e., M1·RD flag to M4·RD flag (to be described later) are set to be "1" (S50).

Processing operations associated with selection switches M1 to M4 are sequentially executed as indicated by dotted blocks 29 to 32 in FIG. 9, and the control returns to an original state (dotted block 29→dotted block 30→dotted block 31→dotted block 32→S61). Since the same processing operations are performed in dotted blocks 29 to 32, only the processing associated with selection switch M1 in dotted block 29 will be described in detail below.

It is checked if selection switch M1 is ON (S51). If the selection switch is not ON, the control advances to the processing associated with selection switch M3 in dotted block 30.

When the player depresses selection switch M1 to turn it on (S51→S52), since the M1·RD flag is "1" (S50); data in M1 information area 20 at addresses "110" to "119" in registration data memory 5 are copied to selection information area 19 at addresses "100" to "109" (S52→S53).

Of the registration data copied on selection information area 19 by the above operation, data at addresses "100" to "102" and "104" to "109" excluding conversion table number 24-3 at address "103" (FIG. 3) are transferred to musical tone generator 7 (S54).

With the above operation, corresponding data in M1 information area 20 are copied to addresses "100" to "102" and "104" to "109" in selection information area 19, and at the same time, the setting content of musical tone generator 7 is instantaneously switched. As a result, a tone color, effect, and the like can be changed in real time.

Based on the conversion table number stored at address "103" on selection information area 19, CPU 1 calculates a start address of a conversion table corresponding to the number on conversion table memory 4, and sets the calculated address in the HL register (2 bytes) (S55). Subsequently, the value of the HL register is added to the value of buffer BLIP, and the sum is set in the HL register (S56). Pitch conversion data written at an address on conversion table memory 4 indicated by the HL register is output to musical tone generator 7 (S57).

The processing operations in steps S55 to S57 are substantially the same as those in steps S5 to S7 in FIG. 5. Therefore, when the player depresses selection switch M1 and data at address "113" of M1 information area 20 is transferred to address "103" in selection information area 19, and a conversion table corresponding to conversion table number 24-3 copied at address "103" is accessed on conversion table memory 4. Thus, pitch conversion data corresponding to lip data is forcibly output to musical tone generator 7. This processing has the same function as the processing in steps S16 to S18 in FIG. 6, and corresponds to the fact that when conversion table number 24-3 is changed, pitch conversion data which is output in correspondence with the table number is changed if the lip data remains the same. When the lip data remains the same (when the player performs the lip operation with an identical strength), even if YES is obtained in step S3 in FIG. 5, this processing is executed to output new pitch conversion data.

After the above processing, the M1·RD flag is reset to "0" (S58), and the control advances to the processing associated with selection switch M2 in dotted block 30.

With the above operation, when the player turns on only selection switch M1 of registration data selection switch group 6, the contents of M1 information area 20 at addresses "110" to "119" in registration data memory 5 are copied to selection information area 19 (FIG. 3) at addresses "100" to "109". At the same time, the setting contents of a tone color, effect, and the like of musical tone generator 7 are instantaneously switched to the selected contents. Thus, the tone color, effect, and the like can be changed in real time. Furthermore, the conversion table selected at conversion table memory 4 is similarly switched, and new pitch conversion data based on the selected conversion table is output to musical tone generator 7 in real time. Therefore, the player can perform the above selection operation at an arbitrary timing during a performance.

Assume that the player continuously depresses selection switch M1, timer interruption in step S46 in FIG. 9 occurs again, and it is detected that selection switch M1 is ON. In this case, however, since the WR·OFF flag is "1" and the M1·RD flag is reset to "0", no processing associated with selection switch M1 is performed, and the control advances to processing operations 30 to 32 for remaining switches M2 to M4. Thus, the same data associated with switch M1 can be prevented from being repetitively selected (S48→S51→S52→dotted block 30).

When selection switches M2 to M4 are operated, the same selection operations are performed for information areas 21 to 23 of M2 to M4.

Another Embodiment

In the above embodiment, when lip data supplied from lip sensor 14 in FIG. 1 to CPU 1 through A/D converter 12 is converted to pitch conversion data, a conversion table in conversion table memory 4 is selected to be paired with a tone color, effect, or the like, using a plurality of switches in registration data selection switch group 6 which can store and reproduce information of tone colors, effects, and the like. However, the present invention is not limited to this. For example, a plurality of conversion tables for converting breath data input from breath sensor 11 to CPU 1 through A/D converter 9 into tone volume or tone quality conversion data can be stored, and one of those conversion tables can be selected to be paired with a pitch conversion table and a tone color, effect, or the like by registration data selection switch group 6. Various other combinations may be adopted.

What is claimed is:

1. An electronic musical instrument comprising:

musical tone generation instructing means for detecting a breath operation state at a mouthpiece portion arranged on an instrument main body, and for instructing generation of a musical tone in response to detection of a breath operation;

detection means for detecting a biting strength at said mouthpiece portion;

control information output means for outputting a plurality of parameter control information items which are used for variably controlling the contents of at least one parameter of the musical tone to be generated, so that the contents differ from one another in response to the biting strength detected by said detection means, as instructed by said musical tone generation instructing means;

designation means for designating any one of the plurality of parameter control information items to be output from said control information output means; and control means, upon detection of the biting strength at said mouthpiece portion by said detection means while said one designated parameter control information item is designated by said designation means, for outputting said one designated parameter control information item in response to detection of the biting strength, and for variably controlling a parameter of the musical tone generated by said musical tone generation instruction means in accordance with the parameter control information item.

2. An instrument according to claim 1, further comprising:

storage means capable of storing selection information for selecting the parameter control information to be designated by said designation means; and writing means for writing the selection information in said storage means.

3. An instrument according to claim 1, wherein said control information output means includes a plurality of conversion table means which upon detection of the biting strength by said detection means, for converting a sensor signal corresponding to the biting strength into corresponding parameter control information, storage means for storing selection information for selecting a specific conversion table from a plurality of said conversion table means, and writing means for writing the selection information in said storage means.

4. An instrument according to claim 1, further comprising display means for displaying the arbitrary one parameter control information designated by said designation means.

5. An instrument according to claim 4, wherein said display means is provided to said instrument main body.

6. An instrument according to claim 1, further comprising musical tone generating means for generating the musical tone whose parameter is variably controlled by said control means.

7. An instrument according to claim 6, wherein said musical tone generating means is provided to said instrument main body.

8. An instrument according to claim 1, further comprising pitch designation means for designating a pitch of the musical tone, whose parameter is controlled by said control means, in accordance with a pitch designation operation to be given by a player.

9. An instrument according to claim 8, wherein said pitch designation means is provided to said instrument main body.

10. An electronic musical instrument to be played by a player, comprising:

detection means for detecting a performance input state selected by said player;

registration means for registering, as a plurality of sets of registration data, a plurality of pairs of parameter control information items and parameter designation information items, said parameter control information items being used for variably controlling the contents of at least one parameter of a musical tone to be generated in accordance with the performance input state detected by said detection means, and said parameter designation information items being used for designating at least one parameter of the musical tone to be generated;

designation means for designating any one of the plurality of sets of registration data registered in said registration means; and control means upon detection of the performance input state selected by said player by said detection means while the set of registration data is designated by said designation means, for variably controlling the musical tone to have the specific tone parameter designated by the parameter designation information items in accordance with the parameter control information items in the set of registration data in response to detection of the performance input state, and wherein said detection means includes means for detecting a biting strength at a mouthpiece portion.

11. An electronic musical instrument comprising:

musical tone generation instructing means for detecting a breath operation state at a mouthpiece portion arranged on an instrument main body, and for instructing generation of a musical tone in accordance with a detected breath operation state;

control information output means for outputting a plurality of parameter control information items which are used for variably controlling the content of at least one parameter of the musical tone to be generated, so that the contents differ from one another in response to the breath operation state detected by said musical tone generation instructing means, on the basis of instruction by said musical tone generation instructing means;

designation means for designating any one of the plurality of parameter control information items to be output from said control information output means;

control means, upon detection of the breath operation state by said musical tone generation instructing means while said one parameter control information item is designated by said designation means, for outputting the one designated parameter control information item in response to detection of the breath operation state, and for variably controlling a parameter of the musical tone generated by said musical tone generation instructing means in accordance with the parameter control information item;

storage means for storing selection information for selecting the parameter control information to be designated by said designation means; and writing means for writing the selection information in said storage means.

12. An instrument according to claim 11, wherein said control information output means includes a plurality of conversion table means for, when the breath operation state is detected by said musical tone generation instructing means, converting a breath sensor signal corresponding to the breath operation state into corresponding parameter control information, storage means for storing selection information for selecting a specific conversion table from a plurality of said conversion table means, and writing means for writing the selection information in said storage means.

13. An instrument according to claim 11 further comprising display means for displaying the arbitrary one parameter control information designated by said designation means.

14. An instrument according to claim 13, wherein said display means is provided to said instrument main body.

15. An instrument according to claim 11, further comprising musical tone generating means for generating the musical tone whose parameter is variably controlled by said control means.

16. An instrument according to claim 15, wherein said musical tone generating means is provided to said instrument main body.

17. An instrument according to claim 11, further comprising pitch designation means for designating a pitch of the musical tone, whose parameter is controlled by said control means, in accordance with a pitch designation operation to be given by a player.

18. An instrument according to claim 17, wherein said pitch designation means is provided to said instrument main body.

19. An electronic musical instrument comprising:

breath operation detection means for detecting a breath operation state at a mouthpiece position;

biting strength detection means for detecting a biting strength at said mouthpiece portion;

selection means for selecting any one of a plurality of different, pre-set conversion characteristics;

conversion means upon detection of a biting strength at said mouthpiece portion by said biting strength detection means while one of the plurality of said conversion characteristics is selected by said selection means, for converting the detected biting strength to a corresponding parameter control information item in accordance with the selected one of said plurality of different, pre-set conversion characteristics; and control means for controlling a parameter of a musical tone generated by said breath operation detection means in accordance with the parameter control information items converted by said conversion means.

20. The electronic musical instrument according to claim 19, further comprising storage means for storing said plurality of different, pre-set conversion characteristics, coupled to said selection means, said selection means operating to select one of said pre-set conversion characteristics from said storage means.

21. An electronic musical instrument to be played by a player, comprising:

detection means for detecting a breath operation state at a mouthpiece portion;

registration means for registering, as a plurality of sets of registration data, a plurality of pairs of parameter control information items and parameter designation information items, said parameter control information items being used for variably controlling the contents of at least one parameter of a musical tone to be generated in accordance with a breath operation state detected by said detection means, and said parameter designation information items being used for designating at least one parameter of the musical tone to be generated;

designation means for designating any one of the plurality of sets of registration data registered in said registration means; and control means, which upon detection of the breath operation state by said detection means while the set of registration data is designated by said designation means, for variably controlling the musical tone to have the specific tone parameter designated by the parameter designation information items in accordance with the parameter control information items in the set of registration data in response to detection of the breath operation state.

22. An instrument according to claim 21 wherein said registration means includes storage means capable of storing the plurality of sets of registration data, and at least one writing means for writing the plurality of sets of registration data in said storage means.

23. An instrument according to claim 21 wherein said designation means includes registration selection switches corresponding in number to the plurality of sets of registration data to be registered in said registration means.

24. An instrument according to claim 21, further comprising:

storage means capable of storing selection information for selecting the parameter control information to be designated by said designation means; and writing means for writing the selection information in said storage means.

25. An instrument according to claim 33, wherein said registration means includes a plurality of conversion table means, which upon detection of the performance input state by said detection means, converts a sensor signal corresponding to the performance input state into corresponding parameter control information, storage means for storing selection information for selecting a specific conversion table from said plurality of conversion table means, and writing means for writing the selection information in said storage means.

26. An instrument according to claim 21, further comprising display means for displaying the arbitrary one parameter control information designated by said designation means.

27. An instrument according to claim 26, wherein said display means is provided to said instrument main body.

28. An instrument according to claim 21, further comprising musical tone generating means for generating the musical tone whose parameter is variably controlled by said control means.

29. An instrument according to claim 28, wherein said musical tone generating means is provided to said instrument main body.

30. An instrument according to claim 21, further comprising pitch designation means for designating a pitch of the musical tone, whose parameter is controlled by said control means, in accordance with a pitch designation operation to be given by a player.

31. An instrument according to claim 30, wherein said pitch designation means is provided to said instrument main body.

32. An electronic musical instrument comprising:

breath operation detection means for detecting a breath operation state;

selection means for selecting any one of a plurality of different, pre-set conversion characteristics;

conversion means upon detection of a breath operation state by said breath operation detection means while one of the plurality of said conversion characteristics is selected by said selection means for converting the detected breath operation state to corresponding parameter control information items in accordance with the one of said plurality of different, pre-set conversion characteristics; and control means for controlling a parameter of a musical tone generated by said breath operation detection means in accordance with the parameter control information items converted by said conversion means.

33. The electronic musical instrument according to claim 32, further comprising storage means for storing said plurality of different, pre-set conversion characteristics, coupled to said selection means, said selection means operating to select one of said pre-set conversion characteristics from said storage means.

* * * * *